US005100090A

United States Patent [19]

Drower

[11] Patent Number: 5,100,090

[45] Date of Patent: Mar. 31, 1992

[54] SHELF FORMED OF A MITER CUT PIECE OF PLASTIC

[75] Inventor: Herbert M. Drower, Wilmette, Ill.

[73] Assignee: Transilwrap Company, Inc., Chicago, Ill.

[21] Appl. No.: 685,726

[22] Filed: Apr. 16, 1991

[51] Int. Cl.[5] ..... A47G 29/02

[52] U.S. Cl. ..... 248/248; 108/152; 211/90; 248/235

[58] Field of Search ..... 248/248, 174, 300, 235; 211/90, 135; 108/152, 112, 114

[56] References Cited

U.S. PATENT DOCUMENTS

| | | | |
|---|---|---|---|
| D. 294,548 | 3/1988 | Wallace . | |
| 1,584,575 | 5/1926 | Waelti | 248/248 |
| 3,178,138 | 4/1965 | Hessdoerfer | 248/300 X |
| 3,549,019 | 12/1970 | Wood | 211/135 |
| 3,580,192 | 5/1971 | Davidson | 108/152 |
| 3,752,088 | 8/1973 | Kapnek | 108/152 |
| 3,863,575 | 2/1975 | Kuns | 211/135 X |
| 4,508,301 | 4/1985 | Nicholson | 211/90 X |
| 4,653,637 | 3/1987 | Wallace . | |
| 4,759,295 | 7/1988 | Nilsen | 248/174 X |

FOREIGN PATENT DOCUMENTS

| | | | |
|---|---|---|---|
| 904439 | 8/1962 | United Kingdom | 211/135 |

*Primary Examiner*—J. Franklin Foss
*Attorney, Agent, or Firm*—Kinzer, Plyer, Dorn, McEachran & Jambor

[57] ABSTRACT

An article adapted to be erected to form a shelf which may be attached to a wall or other vertical support. A generally planar sheet of plastic of generally uniform density is divided by longitudinally-spaced, laterally-extending hinge elements into rectangular sections. The hinge elements are created by miter cuts in the sheet of plastic which do not extend the full thickness of the sheet thereby providing a thin hinge of plastic which functions as the hinge. The rectangular sections are foldable about the hinge elements into a hollow tube which functions as a wall attachment member. At least one of the rectangular sections functions as a shelf member which is supported at one end by the hollow tube. Other rectangular sections may be folded to form a return or nose at the front of the shelf which may be formed with an opening to display a label. Additional rectangular sections may be folded about the sides of the shelf to form strengthening members. Screws, rivets or welding with heat are used to hold the sections together.

9 Claims, 2 Drawing Sheets

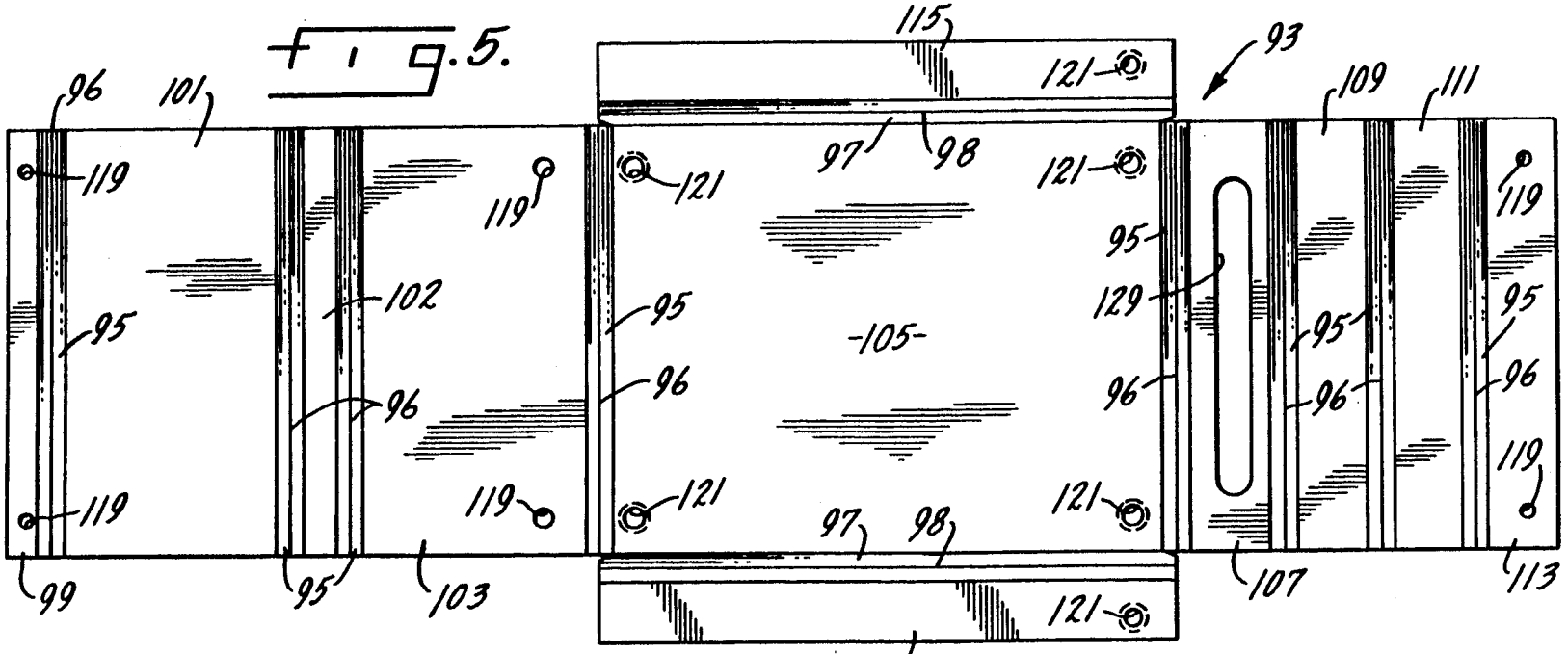
FIG. 5.
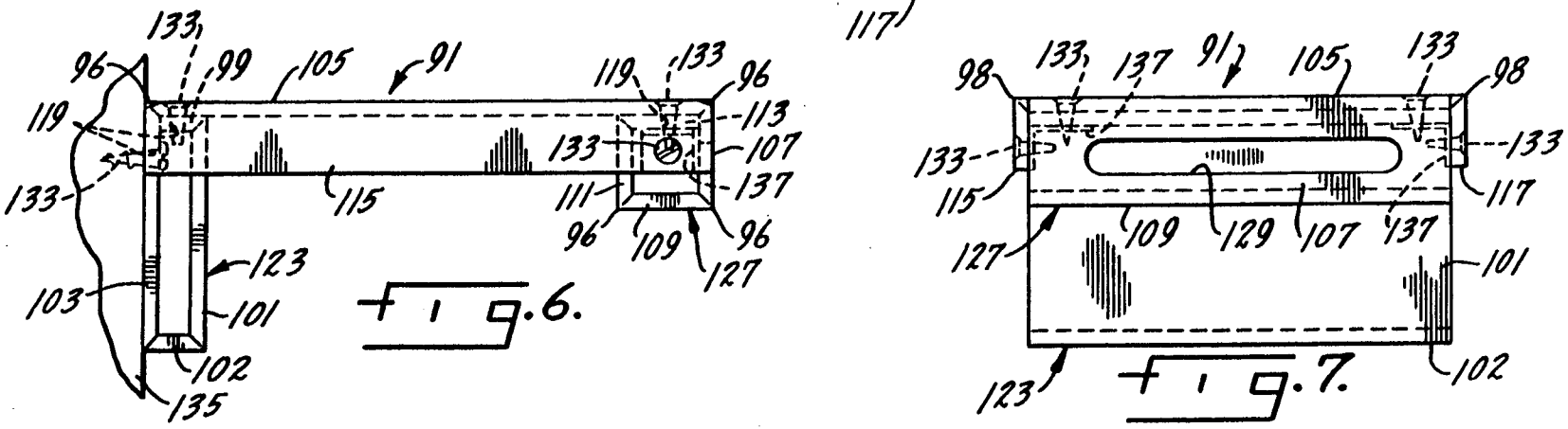
FIG. 6.
FIG. 7.

SHELF FORMED OF A MITER CUT PIECE OF PLASTIC

BACKGROUND AND SUMMARY OF THE INVENTION

This invention is concerned with a novel one-piece shelf made from a single piece of plastic of uniform density which is divided into rectangular sections by hinge elements so that the piece of plastic may be shipped flat and the sections may be folded or erected to form a shelf at the point of installation of the shelf.

An object of this invention is a hinge element for a piece of plastic of uniform density which hinge element is formed by a miter cut in the piece of plastic which cut has a depth less than the thickness of the sheet of plastic.

Another object of this invention is a one-piece shelf formed from a single piece of plastic of uniform density which is formed with rectangular sections which ar folded about fold lines to form an integral wall attachment member.

Yet another object of this invention is a one-piece shelf formed from a single piece of plastic of uniform density which is divided into rectangular sections by fold lines with some of the rectangular sections being foldable into a nose portion at the front of the shelf.

Accordingly, the invention relates to an article adapted to be erected to form a shelf or the like which may be attached to a wall or other vertical support. This article includes a generally planar member divided by longitudinally-spaced, laterally-extending hinge elements into rectangular sections. The rectangular sections are foldable about the hinge elements to form a wall attachment member and a shelf member of a shelf. The wall attachment member includes at least four of the rectangular sections folded into a hollow tube. The shelf member includes at least one of the rectangular sections with the shelf member being supported by the hollow tube. A return or nose portion may be formed at the front of the shelf by folded rectangular sections. Threaded fasteners, rivets or welding with heat are used to extend through the shelf member and into the hollow tube to hold the assembly together and to support it on the wall or other vertical support.

In a novel aspect of this invention, the hinge elements are formed by miter cuts in the planar plastic member, each of which cuts is not as deep as the thickness of the sheet of plastic so that each cut leaves a thin web of plastic to function as a hinge.

BRIEF DESCRIPTION OF THE DRAWINGS

FIG. 5 is a top plan view of yet another modified single sheet of plastic adaptable to being folded to form a shelf;

FIG. 6 is a side elevational view of a shelf formed from the sheet of plastic shown in FIG. 5 and installed on a vertical support; and FIG. 7 is a front elevational view of the installed shelf of FIG. 6.

DESCRIPTION OF THE PREFERRED EMBODIMENTS

Figure 1:
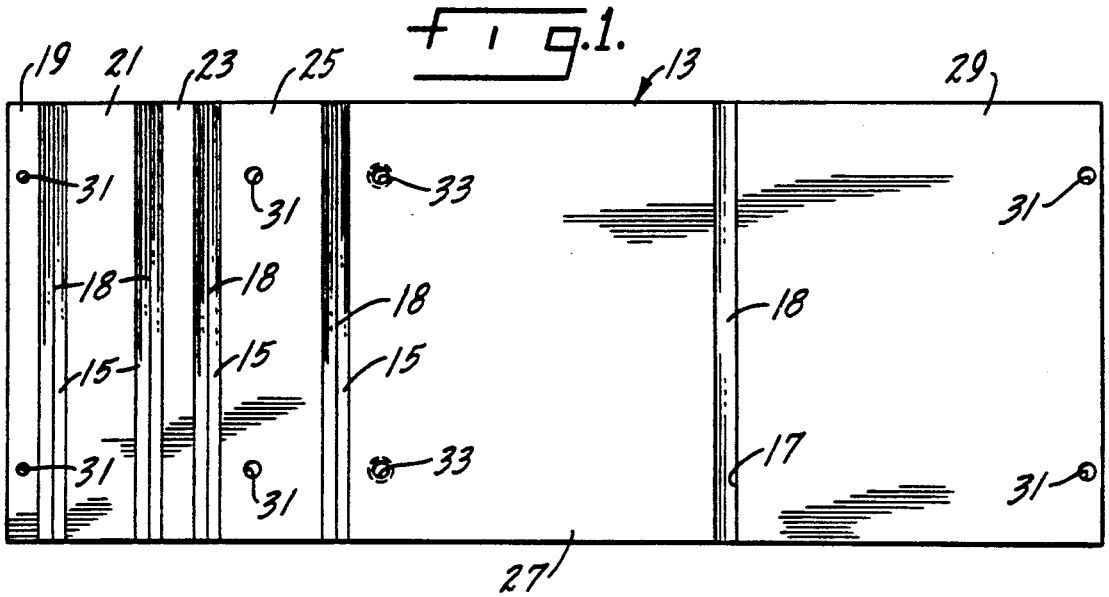
FIG. 1 is a top plan view of a single sheet of plastic divided into rectangular sections by hinge elements which are formed by miter cuts.
Figure 2:
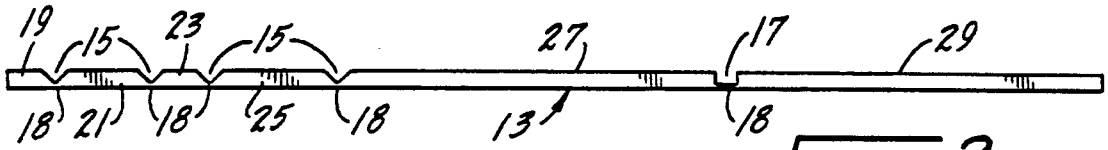
FIG. 2 is a side elevational view of the sheet of plastic of FIG. 1.
Figure 3:
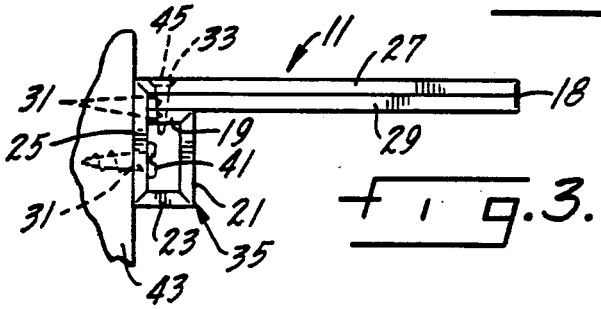
FIG. 3 is a side elevational view of the sheet of plastic of FIG. 1 folded into a shelf and attached to a vertical supporting surface.

FIGS. 1, 2 and 3 of the drawings show a shelf 11 formed from a rectangular sheet 13 of plastic of generally uniform density made in accordance with the teachings of this invention. The sheet of plastic is divided by laterally-extending hinge elements 15 and 17, which are longitudinally spaced apart along the length of the rectangular plastic sheet 13, to form a plurality of rectangular sections. The hinge elements are formed by miter cuts which leave a thin film of plastic at the bottom of each cut to function as a hinge 18. Miter cuts 15 are triangular in vertical cross section while miter cut 17 is rectangular in vertical cross section. A rectangular cut such as cut 17 is advantageous when the contiguous rectangular sections, such as sections 27 and 29, are to be reversely folded against each other. Screw holes 31 are formed in the rectangular sections 19, 25 and 29 while counterbore screw holes 33 are formed in the rectangular section 27.

When a portion of the sheet of plastic 13 is folded about the fold lines 15, a hollow rectangular tube 35 is formed at one end which functions as a wall attachment member for the shelf. This tube is formed by folding rectangular sections 19, 21, 23 and 25 into the rectangular tube. After the tube is formed, the rectangular sections 27 and 29 are folded against one another about the rectangular hinge element 17 and positioned so that the rectangular sections 27 and 29 rest on the rectangular tube 35. Thus, the tube 35 also functions as a strong supporting surface for the shelf 11. Before the final assembly of the folded shelf 11, screws 41 are inserted through the openings 31 in the rectangular section 25 to attach this section to a wall or supporting surface 43. The final step consists of fastening the rectangular sections together with screws 45 which fit into the countersunk screw holes 33 of the rectangular section 27.

Figure 4:
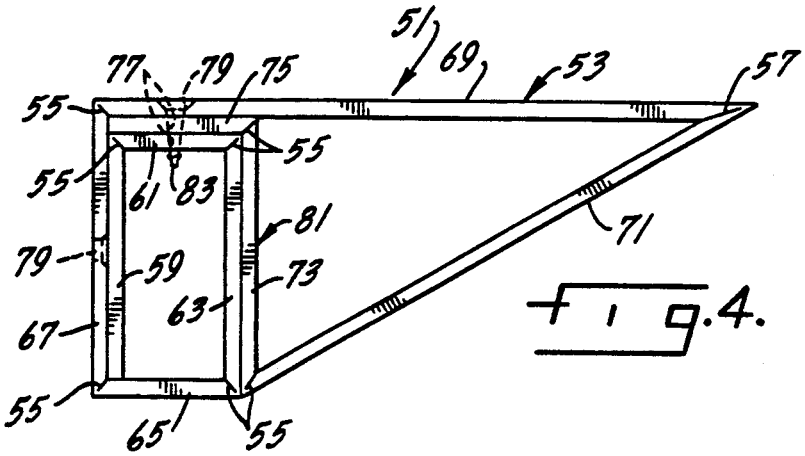
FIG. 4 is a side elevational view of a modified form of shelf formed from a folded sheet of plastic.

In a modified form of my invention shown in FIG. 4 of the drawings, a shelf 51 is formed from a rectangular sheet of plastic 53 with the sheet divided by laterally-extending hinge elements 55 and 57, which are longitudinally spaced, into rectangular sections 59, 61, 63, 65, 67, 69, 71, 73 and 75. The hinge elements 55 and 57 are similar in construction to the hinge elements 15 and 17 previously described with each cut leaving a thin film of plastic at its bottom to function as a hinge. Screw holes 77 are formed in rectangular sections 61 and 75 while counterbore screw holes 79 are formed in rectangular sections 67 and 69. The rectangular sections 59, 61, 63, 65, 67, 73 and 75 are folded about their hinge elements 55 to form a hollow tube 81 which functions as a wall attachment member. The rectangular sections 69 and 71 form a triangular shelf support with the rectangular portions 69 resting on the wall attachment hollow tube 81. Screws 83 extending through the walls 69, 75 and 61 hold the wall attachment hollow tube 81 together while other screws, not shown, extend through the counterbore screw holes 79 in the rectangular section 67 to fasten the shelf 51 to a wall or other support, which are not shown.

FIGS. 5–7 of the drawings show yet another embodiment of my invention in which a shelf 91 is formed from a rectangular sheet of plastic 93. Hinge elements 95 which extend laterally of the sheet of plastic and which are longitudinally spaced along the length thereof are miter cut in the plastic to leave a thin piece 96 of plastic at the bottom of the cut which functions as the hinge. These hinges are cut with triangular vertical cross sections. Additionally, hinge elements 97 of the same triangular cross section extend longitudinally of the piece of plastic and these hinges also have thin elements 98 at their bottoms which function as hinges. The hinge elements 95 and 97 divide the sheet of plastic into rectangular sections 99, 101, 102, 103, 105, 107, 109, 111, 113, 115 and 117. These rectangular sections are of various sizes. Rectangular sections 99 through 113 fold about the length of the rectangular sheet of plastic 93 while sections 115 and 117 fold laterally about their hinges 97 to form reinforcing members for the shelf.

Screw holes 119 are formed in rectangular sections 99, 103 and 113 while counterbore screw holes 121 are formed in rectangular sections 105, 115 and 117. As shown in FIG. 6 of the drawings, the rectangular sections 99, 101, 102 and 103 are folded into a hollow tube 123 which functions as a wall attachment for the shelf unit, while sections 107, 109, 111 and 113 are formed into a nose or return hollow tube 127 at the front of the shelf. An elongated opening 129 is cut in the wall 107 to provide a viewing opening for a label that can be placed in the hollow return 127. The hollow tube wall attachment 123 is attached to the wall 135 by screws 133 and both the hollow tube wall attachment 123 and the nose 127 are held together by the screws. Additionally, the screws 133 attach the reinforcing side rectangular members 115 and 117 to the return 127 by means of brackets 137 inserted in the nose. The use of the reinforcing rectangular sections 115 and 117 allow the use of the single thickness section 105 as the shelf portion.

I claim:

1. An article adapted to be erected to form a shelf or the like which may be attached to a wall or other vertical support, including:

a generally planar member of plastic of generally uniform density divided by longitudinally-spaced, laterally-extending hinge elements into rectangular sections, said rectangular sections being foldable about said hinge elements to form a wall attachment member and a shelf member, said wall attachment member including at least four of said rectangular sections folded into a hollow tube, said shelf member including at least one of said rectangular sections with said shelf member supported by said hollow tube, and threaded fasteners extending through said shelf member and into said hollow tube to hold the assembly together.

2. The shelf of claim 1 in which said shelf member includes first and second rectangular sections which are connected by a hinge element.

3. The shelf of claim 2 in which said first and second rectangular sections are folded against each other to form said shelf member.

4. The shelf of claim 2 in which said first and second rectangular sections of said shelf member are positioned relative to each other to form a triangle with said wall attachment member.

5. The shelf of claim 1 further including a narrow, longitudinally-extending rectangular section formed at the outer edge of some of said rectangular sections, with said narrow rectangular section joined to and folded about its rectangular section by a hinge element.

6. The shelf of claim 1 in which said generally planar member is formed of a plastic of generally uniform density and said hinge elements are formed by miter cuts in said planar member, each of which cuts leaves a thin web of plastic to function as a hinge.

7. The shelf of claim 1 further including a return attached to said shelf member, said return including as many as four of said rectangular sections folded about hinge elements into a hollow rectangular tube and held together by removable fasteners.

8. An article adapted to be erected to form a shelf or the like for attachment to a wall or other vertical surface, including:

a generally planar member formed of a plastic of generally uniform density divided by first hinge elements into first rectangular sections having first edges which extend parallel to said wall and second edges which extend normal to said wall, with said first hinge elements being formed along said first edges, said first rectangular sections being foldable about said first hinge elements along said first edges to form a wall attachment member and a shelf member, said wall attachment members each consisting of a plurality of said rectangular sections folded into a hollow tube with one said folded rectangular section positioned against said wall or support, said shelf member including at least one of said first rectangular sections with said shelf member supported by said wall attachment member, and threaded fasteners extending through said shelf member and into said wall attachment member to hold said shelf in an erected condition.

9. The article of claim 8 further including second hinge elements formed along said second edges and additional rectangular panels attached to said second edges by said second hinge elements, said additional rectangular panels being foldable about said second hinge elements against said first rectangular sections of said shelf member to reinforce said shelf member.

* * * * *